United States Patent [19]

Kamphaus

[11] 4,157,003

[45] Jun. 5, 1979

[54] MACHINE FOR A CONTINUOUS COMMERCIALLY PACKING OF SLAUGHTERED FOWL

[75] Inventor: Josef Kamphaus, Lohne, Fed. Rep. of Germany

[73] Assignee: Firma Geflügelschlachterei Gebr. Stolle, Visbek über Vechta, Fed. Rep. of Germany

[21] Appl. No.: 873,334

[22] Filed: Jan. 30, 1978

[51] Int. Cl.[2] ..... B65B 43/36; B65B 39/02

[52] U.S. Cl. ..... 53/572; 53/258; 53/385

[58] Field of Search ..... 53/124 D, 124 E, 189, 53/258, 385

[56] References Cited

U.S. PATENT DOCUMENTS

| | | | |
|---|---|---|---|
| 2,946,166 | 7/1960 | Baxter | 53/124 E |
| 3,455,084 | 7/1969 | Broersma et al. | 53/124 D |
| 3,935,691 | 2/1976 | Broch | 53/189 X |
| 4,033,088 | 7/1977 | Markert | 53/189 X |

*Primary Examiner*—Travis S. McGehee

*Attorney, Agent, or Firm*—Allison C. Collard; Thomas M. Galgano

[57] ABSTRACT

An improved machine for continuous commercial packing of slaughtered fowl into bags of the type having a packing funnel, a piston which pushes the fowl through the packing funnel and a bag supply which is provided at the discharge opening of the packing funnel, is provided which includes a centering tool disposed in front of the entrance opening of the packing funnel. The centering tool includes means for enclosing the legs of the slaughtered fowl and pushing the legs into the path of the piston, which means is moveable in timed relationship with respect to the piston.

9 Claims, 3 Drawing Figures

MACHINE FOR A CONTINUOUS COMMERCIALLY PACKING OF SLAUGHTERED FOWL

The present invention relates to a machine for the continuous packing of slaughtered fowl into bags made of foil. More particularly, it relates to such a machine having a packing funnel, a piston which pushes the slaughtered fowl into the packing funnel and a bag supply which is provided at the discharge end of the packing funnel.

Slaughtered fowl, for example, chickens, are packed into plastic bags after slaughter and are then frozen. In view of the machine-type slaughtering process, wherein the animals are hung by their feet, a very unfavorable packing operation results due to the stretched position of the animals. The term "commercially packed", as used hereinafter, is to be understood that the animal body is packed in a crouched position, that is, the legs which extend from the body are pressed against the body.

A machine is already known, wherein the animal bodies are pushed through a packing funnel by means of a piston and are then pushed into the discharge opening of the funnel and into a plastic bag which is provided in front of the discharge opening of the packing funnel. However, before the bags can be closed, the animal body contained therein has to be brought into a crouched position. This commercial packing operation is done manually by an operator. For servicing this known machine, two operators are required, namely, a first operator for feeding the animal bodies into the machine and a second operator for locking the bags which are discharged from the machine and for arranging the animal bodies in a crouched position.

It is, therefore, an object of the invention to improve a machine of the aforementioned type, so that the manual operations are reduced to a minimum. This object of the invention is attained in accordance with the present invention in that a time-related centering tool is arranged in front of the packing funnel which grasps the legs of the chicken and aligns the same with the stroke line of the piston. Before the piston can engage the animal body, in order to push it through the packing funnel and into the bag, the ends of the legs are grasped by closing the shanks of the centering tool. Thereby, the pushing piston engages the animal body at the free ends of the animal body. During the movement through the tapered funnel, a resistance is created with respect to the forward moving piston, whereby the legs of the animal body are pushed into a crouched position. In this position, the animal body is pushed through the funnel by the piston and into the bag. The only manual operation remaining with this novel machine is the introduction of the animal bodies into the packing funnel or onto a working platform which is provided at the same operating height of the piston, respectively, or any other suitable feeding arrangement.

In accordance with the present invention, the mouth or edges of the bag is pushed over the discharge opening of the packing funnel. This bag must be held at the packing funnel during the insertion of the animal body into the bag. This is advantageously carried out in that a bag clamp is provided at the discharge opening of the packing funnel which is operatively coupled with the drive of the centering tool. Due to the coupling of the bag clamp with the centering tool, during the closing of the centering tool and before inserting the animal body, the bag clamp is advantageously tightly pressed from the outside onto the discharge opening of the packing funnel. The clamping may be carried out, for example, by pretension of a spring. Thereby, the mounted bag is held in position between the packing funnel and the bag clamp. On the other hand, the bag clamp is released at the time the centering tool moves into its upper starting position. This assures that the bag with the inserted animal body can be easily remove from the packing funnel.

In order to ensure an automatic operation for mounting the bags onto the packing funnel, in a further embodiment of the invention, a bag supply is provided which includes a time related reciprocating carrier moveable along the stroke line of the piston. The carrier is provided with a compressed air nozzle which blows air into the uppermost bag of the stacked bags. As soon as a filled bag is withdrawn from the packing funnel, the carrier returns and moves away from the discharge opening of the packing funnel. Thereby, the carrier moves against a switch which switches the compressed air admittance for the nozzle, so that the uppermost bag of the stack of bags is blown up. By maintaining the compressed air flow, the carrier moves forward, so that the edge portions of the blown up bag are placed over the discharge orifice of the packing funnel. After the bag clamp is actuated, the compressed air flow can be switched off. At this point, the machine is ready for packing a subsequent animal body.

For increasing the operating safety, in particular, to insure a packing of the animal bodies in crouched position, the front face of the piston is advantageously provided with a recess. During the forward movement of the piston, the ends of the legs cannot slide out of this recess. The centering tool of the inventive machine is preferably moved in a vertical direction. For this purpose, the free ends of the shanks of the centering tool are guided on the arms of a preferably U-shaped yoke which is mounted vertically in front of the packing funnel, and through which the piston moves. The centering tool has a downwardly-opening semi-circular shape similar to the U-shaped yoke. This ensures that the legs of the slaughtered animals which have to be aligned with the front face of the piston are enclosed between the cooperating yoke-shaped members when the centering tool moves from its upper starting position downwardly. In order to enclose the legs of the animals securely, a tension spring is provided for the centering tool which holds the shanks of the centering tool in a straddling position. The centering tool itself is moved vertically by an operating cylinder in the guide plane of the U-shaped yoke.

In a preferred embodiment of the invention, an articulated, spring-biased clamping yoke is provided at a support of the operating cylinder for the centering tool which presses against the edge zone or rim of the discharge opening of the packing funnel for fixing the bags on the discharge opening of the packing funnel. The clamping yoke is moved to a release position, under an increase of spring tension, by movement of the centering tool to its uppermost starting position at which point, it is removed from the discharge opening of the packing funnel. The solution, to couple the centering tool and the bag clamp, is very simple in its construction, so that a safe operation is assured with a minimum of structural parts.

In order to further facilitate the continuous packing with the inventive machine, it is further provided that at the discharge end of the machine a known sealing machine for sealing the filled bags is arranged in such a manner that the control of the sealing machine for sealing the filled bags is the actuating means for the work cycle of the successive steps during packing.

Other objects and features of the present invention will become apparent from the following detailed description when taken in connection with the accompanying drawings which discloses embodiment of the invention. It is to be understood that the drawings are designed for the purpose of illustration only, and are not intended as a definition of the limits and scope of the invention disclosed.

In the drawings, wherein similar reference numerals denote similar elements throughout the several views.

Figure 1:
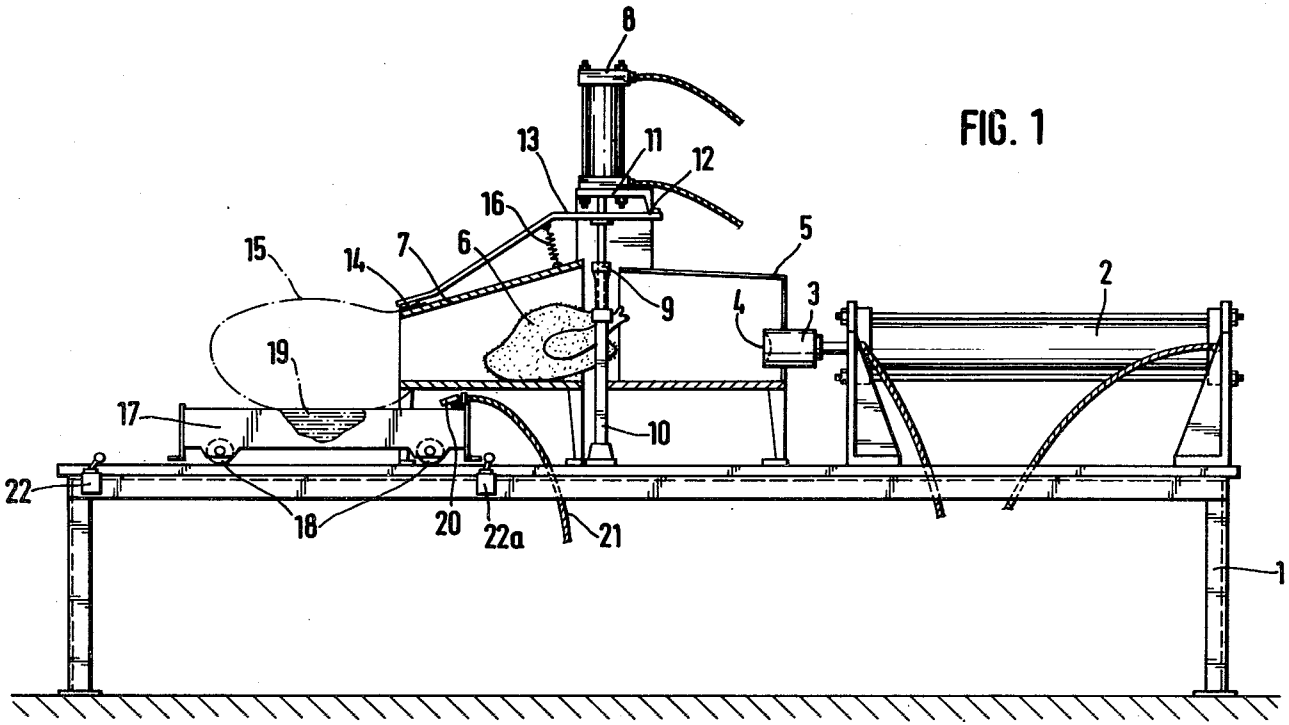
FIG. 1 is an elevational view, in part section, of a machine embodying the present invention.

Referring now to FIG. 1 therein illustrated is a side view of a machine embodying the present invention which is mounted on a table-like frame 1. In the longitudinal direction of the table-like frame, a cylinder 2 operates a reciprocally moveable piston 3, the front face 4 of which is provided with an inwardly shaped recess. Piston 4 which is shown in its retracted position, moves forward into an inserting chute 5 which is open towards its upper portion (not shown) for receiving a chicken 6; chute 5 also communicates with packing funnel 7. Centering tool 9 is provided between insertion chute 5 and packing funnel 7, and is moved in a vertically-reciprocal operating cycle by means of cylinder 8. Centering tool 9 is guided on the lateral, vertically-extending arms of yoke 10. A clamping yoke 13 is articulately mounted on support 11 of the working cylinder 8 at support point 12, and has a free end which acts as a bag clamp 14 for clamping a plastic bag 15 onto the discharge opening of the packing funnel 7. Bag clamp 14 is constantly pressed from the outside against the funnel 17 due to clamping yoke 13 which is pretensioned by means of spring 16. A bag supply 17 is shown which includes a moveable carriage which reciprocally moves in the longitudinal direction of frame 1. The bag supply is mounted on the horizontal support of frame 1 by means of rollers 18. On the carriage is a stack of bags 19. For opening or spreading bags 15 of bag supply 19, a compressed air nozzle 20 with a supply hose 21 is coupled with the carrier. As seen in FIG. 1, end switches 22 and **22*a*** are actuated by the reciprocating carrier. The end switches control the cycle of the successive operating steps during the packing of slaughtered fowl.

Figure 2:
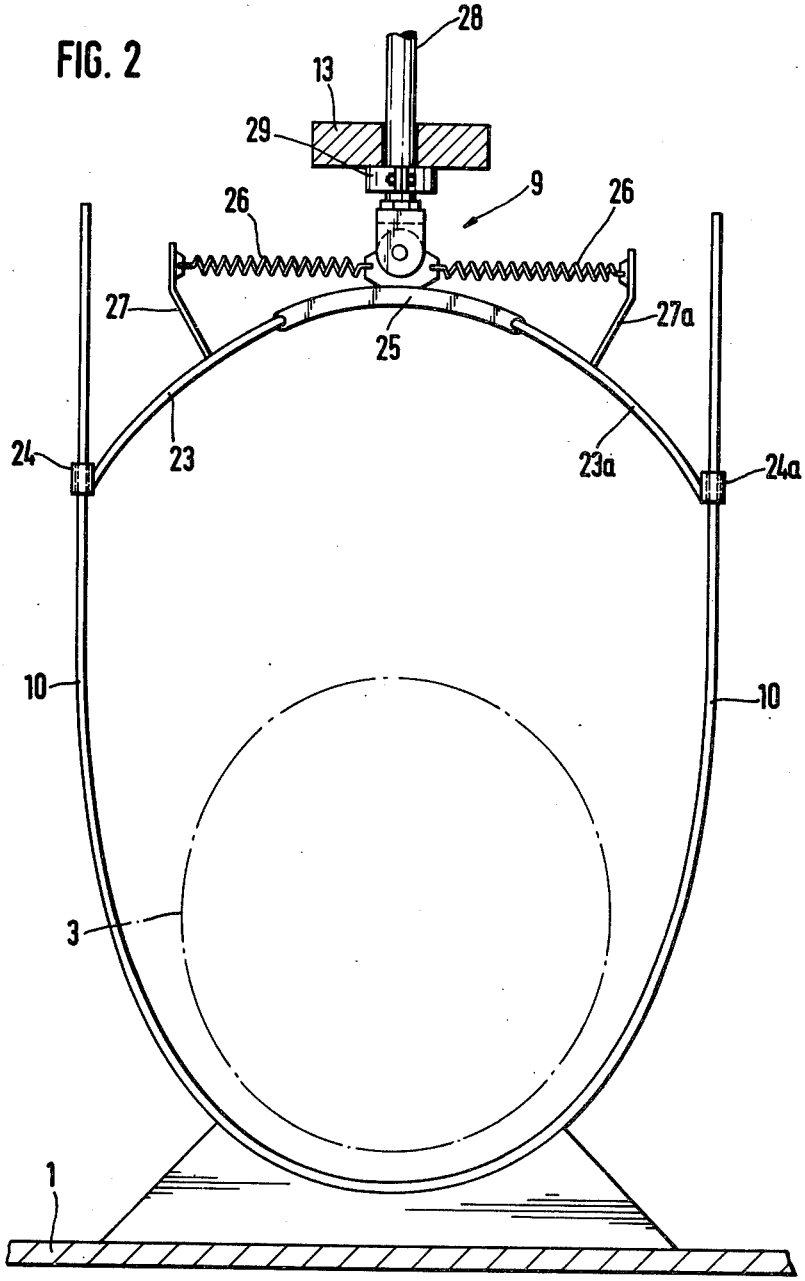
FIG. 2 is an enlarged end view of the centering tool of the machine shown in FIG. 1.

FIG. 2 is an end view of centering tool 9, taken along the longitudinal direction of table-like frame 1. As can be seen, yoke 10 which guide shanks 23 and **23*a* and centering tool 9 is U-shaped. The yoke is so shaped that piston 3 (shown in dotted lines) can pass through the center section thereof. Slide elements 24 and 24*a* are provided at the free ends of yoke 10 for guiding shanks 23 and 23*a* of centering tool 9. Shanks 23, 23*a* of centering tool 9 are hingedly mounted on a tool head 25 and are held in a straddling position by means of tension spring 26. Tension spring 26 engages ribs 27 and 27*a* which extend from shanks 23 and 23*a*** respectively.

A piston rod 28 of cylinder 8 extends through clamping yoke 13 (FIG. 1). Clamping yoke 13 is also moved due to protrusions or collars 29, which are provided on piston rod 28, when centering tool 9 is moved into its uppermost position by means of piston rod 28.

Figure 3:
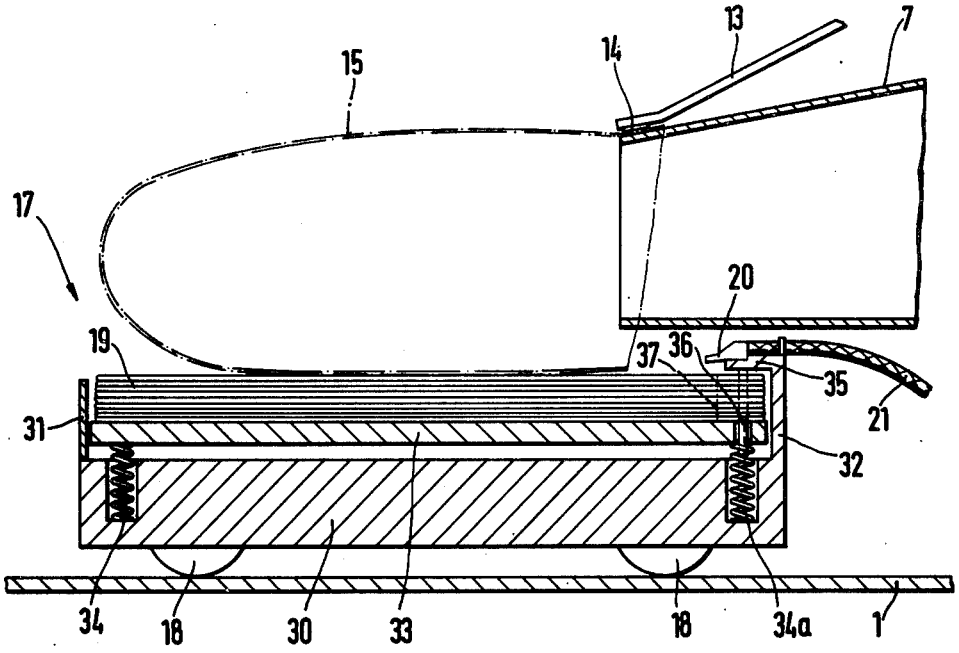
FIG. 3 is an enlarged, elevational side view, in part section, of the bag supply shown in FIG. 1.

FIG. 3 shows a side view of the bag supply in accordance with FIG. 1. For a clearer view, the bag supply is shown in a longitudinal direction. The bag supply 17 consists of a base plate 30 and is moveable by means of laterally-mounted roller elements 18, in the longitudinal direction of table-like frame 1. At its upper side, base plate 30 has a box-like structure defined in part by side walls 31 and 32. Between these walls a bottom plate 33 is provided which is pushed upwardly by pressure springs 34 and **34*a*. Side wall 32 is provided with a horizontally extending inwardly-turned edge or shoulder 35 which extends slightly over the stack of bags 19 which are disposed on bottom plate 33, so that a clamping of the bags between bottom plate 33 and shoulder 35 is obtained due to the pressure of spring 34*a*. In the horizontal plane, the bags are fixed and held in place by means of a vertically-downwardly extending mandrel 36. This mandrel permits tearing of the filled bag for removal. To facilitate this purpose, the bags are provided with a weakened portion 37** indicated by dots.

Compressed air nozzle 20 is admitted with compressed air through feed hose 21, whereby the uppermost bag of supply stack 19 is opened or blown open, respectively, as shown in the dash-dotted lines. As soon as bag 15 is blown up, it is moved forwardly by the bag supply over the discharge opening edge or rim of packing funnel 7 and held there by bag clamp 14. The device then operates in the following manner:

With the right hand, an operator inserts an animal body 6 for packing into inserting chute 5. Simultaneously, the operator has removed a packed animal which is in a bag 15 from the bag supply and to the bag sealing machine (not shown) with his left hand, whereat the sealing machine is actuated, for example, by foot pressure. This actuating process which is necessary for sealing the bag by the sealing machine actuates the work cycle. First, the bag supply moves against end switch 22, whereby the compressed air nozzle 20 is admitted with compressed air from hose 21. Thereby, the uppermost bag 15 of the supply is blown up. Simultaneously, the bag supply moves and engages end switch **22*a*, whereby the blown up bag is moved over the edge of the discharge opening of packing funnel 7. End switch 22*a* cuts off the compressed air supply and the centering tool 9 is moved downwardly by operating cylinder 8. At the same time, piston 3 is moved forward which pushes the animal body from insert chute 5 forwardly, whereby the downward moving centering tool moves the legs of the animal body in front of face 4 of the piston. Thereby, the animal body is moved further into packing cylinder 7. Even after leaving the operating effect of centering tool 9, the free ends of the legs cannot slide off piston 3, because they are retained by the recess in front face 4 of piston 3. Due to the increased resistance force while the animal body passes the tapered packing funnel, the legs are brought into a crouched position. In this position, animal body 6 is pushed by piston 3 into bag 15 which is held in a fixed position by bag clamping element 14 at the discharge end of packing funnel 7. Thereby, the bag tears at the weakened line 37 which is held in position by the mandrel 36 within the bag supply. After the centering tool is retracted together with the retracted piston 3, the filled bag can be removed, because clamping yoke 13 with bag clamp 14** releases the bag from the discharge opening of the packing funnel. By sealing the filled bag, the total operating cycle is repeated.

While only one embodiment of the present invention was shown and described, it will be obvious to those persons of ordinary skill in the art that many changes and modifications may be made thereunto without departing from the spirit and scope of the invention.

What is claimed is:

1. An improved machine for continuous commercial packing of slaughtered fowl into bags of the type having a packing funnel, a piston which pushes the fowl through the packing funnel and a bag supply which is provided at the discharge opening of the packing funnel, the improvement comprising:

a centering tool disposed in front of the entrance opening of the packing funnel, said centering tool including means for enclosing the legs of the slaughtered fowl and pushing the legs into the path of said piston, said means being movable in timed relationship with respect to said piston;

drive means for reciprocally moving said means for enclosing and pushing between an operating and non-operating position; and a bag clamping element coupled to and actuated by said drive means for clamping a bag from said bag supply onto the rim of said discharge opening of said packing funnel.

2. The machine according to claim 1, wherein said bag supply includes a horizontally-reciprocal carriage for supporting a stack of bags which is moveable toward and away from the discharge opening of said packing funnel along a path in parallel alignment with respect to said path of said piston which carriage is moveable in timed relationship with respect to said piston, and a compressed air operated nozzle mounted on said carriage which is disposed to blow air into the uppermost bag of said stack.

3. The machine according to claim 1, wherein the front face of said piston is provided with a recess.

4. The machine according to claim 1, wherein said means for enclosing and pushing includes a vertically-disposed fixed guide, mounted in front of said entrance opening of said packing funnel through which said piston is moveable and a pair of shank members moveably supported on said guide which are disposed to straddle the fowl disposed therebetween.

5. The machine according to claim 4, wherein said guide comprises an upwardly opening, U-shaped yoke, on each of the arms of which the outer end of one of said shank members is slidably supported.

6. The machine according to claim 5, wherein said centering tool, in cooperation with said shank members thereof, define a generally downwardly-opening semicircular clamping surface which compliment said upwardly opening U-shaped yoke.

7. The machine according to claim 4, additionally including a pretensioned spring coupled to said shank members for maintaining said shank members in a straddling position.

8. The machine according to claim 4, wherein said drive means comprises a cylinder having a piston rod which is vertically moveable between a retracted and an extended position, both of which lie in the same plane as said yoke.

9. The machine according to claim 8, additionally including a support mounted on said piston rod, and a spring-loaded clamping yoke pivotably mounted on said support, one end of which supports said bag clamping element, said clamping yoke being pivotably moveable between a clamping position, in which said end of said clamping yoke and, in turn, said bag clamping element is urged against said rim of said discharge opening of said packing funnel to clamp a bag therebetween and, a non-clamping position, in which said bag clamping element and said end thereof is moved away from contact with said rim of said discharge opening to permit release of said bag, said clamping position being effected by movement of said piston rod from said retracted to said extended position thereof and said non-clamping position being effected by movement of said piston rod from said extended to said retracted position thereof.

* * * * *

UNITED STATES PATENT AND TRADEMARK OFFICE

CERTIFICATE OF CORRECTION

PATENT NO. : 4,157,003

DATED : June 5, 1979

INVENTOR(S) : Josef Kamphaus

It is certified that error appears in the above-identified patent and that said Letters Patent are hereby corrected as shown below:

Column 2, line 10, "remove" should read -- removed --

Column 3, line 11, after "discloses" inser -- one --.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*